US011235368B2

(12) United States Patent
Zeh et al.

(10) Patent No.: US 11,235,368 B2
(45) **Date of Patent: *Feb. 1, 2022**

(54) METHOD FOR MARKING WORKPIECES, AND WORKPIECE

(71) Applicant: Fraunhofer-Gesellschaft zur Förderung der angewandten Forschung e.V., Munich (DE)

(72) Inventors: Christoph Zeh, Dresden (DE); Thomas Härtling, Dresden (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 146 days.

This patent is subject to a terminal disclaimer.

(21) Appl. No.: 16/337,860

(22) PCT Filed: Sep. 21, 2017

(86) PCT No.: PCT/EP2017/073943

§ 371 (c)(1),
(2) Date: Mar. 28, 2019

(87) PCT Pub. No.: WO2018/065228

PCT Pub. Date: Apr. 12, 2018

(65) Prior Publication Data

US 2020/0030865 A1 Jan. 30, 2020

(30) Foreign Application Priority Data

Oct. 5, 2016 (DE) ..... 10 2016 118 842.5

(51) Int. Cl.
*B21C 51/00* (2006.01)
*B22D 11/12* (2006.01)
(Continued)

(52) U.S. Cl.
CPC ..... *B21C 51/005* (2013.01); *B05D 7/14* (2013.01); *B21D 1/02* (2013.01); *B21D 1/06* (2013.01); *B22D 11/1233* (2013.01)

(58) Field of Classification Search
None
See application file for complete search history.

(56) References Cited

U.S. PATENT DOCUMENTS 3,534,574 A * 10/1970 McMaster ..... B21B 11/00 72/57
4,106,435 A 8/1978 Woodhouse et al.
(Continued)

FOREIGN PATENT DOCUMENTS

AT 411579 B 3/2004
DE 2511612 A1 9/1975
(Continued)

*Primary Examiner* — James M Mellott
(74) *Attorney, Agent, or Firm* — Slater Matsil, LLP

(57) ABSTRACT

A method for marking a wordpieces and workpiece are disclosed. In an embodiment the method includes applying an identification to a blank in places and after applying the identification to the blank, deforming the blank to form a metal body, wherein deforming the blank comprises rolling so that a thickness of the blank changes more strongly than a width of the blank when the metal body is formed, wherein the identification remains on the metal body at least until after deforming the blank and is not destroyed by deforming the blank, and wherein the identification, both to the blank and to the metal body, has at least one of a difference in reflection or a difference in remission and an albedo difference of at least 15 percentage points in at least part of at least one of a near ultraviolet spectral region, a visible spectral region or a near-infrared spectral region.

19 Claims, 4 Drawing Sheets

(51) Int. Cl.

| | |
|---|---|
| ***B05D 7/14*** | (2006.01) |
| ***B21D 1/06*** | (2006.01) |
| ***B21D 1/02*** | (2006.01) |

(56) References Cited

U.S. PATENT DOCUMENTS

| | | | | |
|---|---|---|---|---|
| 4,883,720 | A | 11/1989 | Stangl | |
| 10,086,420 | B2 * | 10/2018 | Zeh | B21C 51/00 |
| 2012/0087061 | A1 * | 4/2012 | Thompson | H01G 9/15<br>361/502 |
| 2016/0339495 | A1 | 11/2016 | Zeh et al. | |

FOREIGN PATENT DOCUMENTS

| | | | | | |
|---|---|---|---|---|---|
| DE | 2617671 | A1 | | 11/1976 | |
| DE | 20002398 | U1 | | 8/2000 | |
| DE | 102015107744 | B3 | | 7/2016 | |
| EP | 0341234 | A2 | | 11/1989 | |
| GB | 1 460 292 | | * | 12/1976 | B22D 7/00 |
| GB | 1495097 | A | | 12/1977 | |
| JP | S5115456 | B | | 5/1976 | |
| JP | S5773473 | A | | 5/1982 | |
| JP | S59215216 | A | | 12/1984 | |
| JP | H06000517 | U | | 1/1994 | |

* cited by examiner

METHOD FOR MARKING WORKPIECES, AND WORKPIECE

This patent application is a national phase filing under section 371 of PCT/EP2017/073943, filed Sep. 21, 2017, which claims the priority of German patent application 102016118842.5, filed Oct. 5, 2016, each of which is incorporated herein by reference in its entirety.

TECHNICAL FIELD

The invention relates to a method for marking workpieces. The invention further relates to a workpiece produced in this way.

BACKGROUND

A method in which metallic components are provided with a phosphor marking is specified in International Publication No. WO 2011/10001 A1.

A marking method in hot forming is known from German Publication No. DE 10 2015 107 744 B3.

SUMMARY OF THE INVENTION

Embodiments provide a workpiece which is produced by rolling and which has an identification.

According to at least one embodiment, the method comprises the step of providing a blank. The blank is, for example, a slab or a sheet metal roll, also referred to as a coil. In particular, the material of the blank is a metal such as iron, an iron alloy, steel, a steel alloy, aluminum, an aluminum alloy or a non-ferrous metal. A weight of the blank is, for example, at least 0.5 t or 1 t or 5 t and/or at most 20 t or 12 t.

According to at least one embodiment, the method comprises the step of applying one or more identifications to the blank. The at least one identification is preferably applied to the blank only in places and not over the whole area. Here and in the following, an 'identification' can mean any type of marking or coding. The identification is applied, for example, in the form of a character or a number or a sign. The identification is preferably a machine-readable coding, for example, in the form of a bar code or a two-dimensional code. By means of the identification, it is possible, for example, to give the blank a unique component number. Furthermore, it can be possible to uniquely identify particular subregions of the blank, in that, for example, a continuous numbering of subregions extend over the blank.

The identification preferably comprises one or more types of pigments. In the following, the term pigment is used as the generic term for color pigments without phosphor properties, that is, without the ability to convert wavelengths, and is also used for luminescent substances. Particularly preferably, the pigments do not melt or at least do not completely melt during the method. The pigments are preferably present as particles. An average particle diameter of the pigments is, for example, at least 0.1 μm or 0.3 μm and/or at most 5 μm or 3 μm.

According to at least one embodiment of the method, the blank is deformed into the metal body. This is carried out at least by means of one rolling. The rolling can be carried out above a crystallization temperature as hot rolling or alternatively as cold rolling. In particular, a flat product is produced by means of the rolling, said flat product having a width which is greater than a thickness and having a length which is greater than the width. Particularly preferably, during rolling the thickness of the blank changes more than the width of the blank.

According to at least one embodiment, a metal body is formed from the blank by the rolling. The metal body does not have to be an end product. It is possible that the metal body is used in a further method step such as a further rolling as a further blank for a further metal body.

According to at least one embodiment, the identification remains on the metal body at least until after the blank is deformed. The identification is not destroyed by the rolling of the blank to form the metal body and remains preferably readable, in particular machine-readable.

According to at least one embodiment, the identification, both to the blank as well as to the metal body, comprises a difference in reflection and/or a difference in remission and/or an albedo difference of at least 15 percentage points or 25 percentage points or 50 percentage points in at least part of the near ultraviolet, visible and/or near-infrared spectral region.

In other words, the identification can be clearly distinguished on account of its optical properties both from a surface of the blank before the shaping and from a surface of the metal body after the shaping, for example, by a camera or by the human eye. In other words, the identification has a high contrast relative to a surface of the blank and of the metal body, at least under suitable illumination conditions which are used for reading out the identification. The near ultraviolet spectral range is understood in particular to mean the range from 300 nm to 420 nm, the visible spectral range, in particular, designates wavelengths of 420 nm to 760 nm and the near-infrared spectral range refers to wavelengths of 760 nm to 1500 nm. It is possible that optical filters are used for reading out the identification, which block an excitation wavelength of a luminescent substance, for example, so that then only the radiation generated by the phosphor due to the excitation is detected. In particular, with regard to the contrast and/or a brightness difference, the identification satisfies the current standard ISO/TEC TR 29158, which is required for directly marked components.

In at least one embodiment, the method comprises the following steps: A) provision of a blank, B) application of an identification to the blank in places, and C) deformation of the blank to form a metal body, wherein the deformation in step C) is a rolling so that towards the metal body a thickness of the blank changes more strongly than a width of the blank, wherein the identification remains on the metal body at least until after step C) and is not destroyed by the deformation, and wherein the identification, both to the blank as well as to the metal body, has a difference in reflection and/or a difference in remission and/or an albedo difference of at least 15 percentage points in at least part of the near ultraviolet, visible and/or near-infrared spectral region.

The individual method steps are preferably carried out one after the other and in the specified order.

According to at least one embodiment, the method comprises a step D). Step D) preferably follows step C). Step D) is a temperature treatment of the metal body. The temperature treatment is preferably a tempering or an annealing of the metal body. In particular, it is a recrystallization annealing, alternatively a soft annealing, a stress-relief annealing, a normal annealing, a coarse grain annealing, a diffusion annealing or a solution annealing.

According to at least one embodiment, a temperature in the temperature treatment is at least 350° C. or 450° C. or 600° C. or 700° C. or 1050° C. Alternatively or additionally, the temperature is at most 1300° C. or 900° C. or 750° C. or 550° C. In particular, the temperature is 500° C. or 650° C. or 710° C. or 800° C. or 1200° C., for example, with a tolerance of 20° C. in each case.

According to at least one embodiment, the temperature treatment lasts at least 1 h or 12 h or one day or three days or one week. Alternatively or additionally, the temperature treatment lasts at most one month or two weeks or one week. Thus, the temperature treatment lasts comparatively long, relative to the deformation of the blank to the metal body.

According to at least one embodiment, the identification is predominantly or completely pressed into the blank and/or the metal body during the shaping of the blank. 'Predominantly' can mean a proportion of at least 50% or 80% or 95%. In particular, the identification does not protrude out of the metal body after deforming. The identification can terminate flush with a surface of the metal body.

According to at least one embodiment, the identification is readable, in particular machine-readable, both before the step of deforming the blank to the metal body as well as after the step of temperature treatment.

It is possible for at least one optical property of the identification to change during the step of deforming the blank to the metal body and/or during the temperature treatment. This can result in the identification being read out before and after one of these steps in different spectral ranges.

According to at least one embodiment, the identification is applied to both ends of the blank. In particular, one identification is then located at both ends of a sheet-metal roll, which forms the blank and/or the metal body. Alternatively or additionally, the identification is located on two mutually opposite sides, especially main sides, of the blank and/or of the identification. Preferably, the identification is applied to both ends of the blank on both sides and is still present at corresponding locations of the metal body after the deformation.

According to at least one embodiment, the identification is applied in a distorted manner. A distortion factor preferably corresponds to a thickness change factor and/or to a length change factor during the subsequent deformation. Thus, the identification is preferably applied compressed along a rolling direction. In this way, it is possible that a change in length and/or a change in thickness of the blank towards the metal body takes place during the deformation, so that the compression of the identification is removed during deformation and the identification can be read without problems after deforming.

According to at least one embodiment, the identification comprises, as pigments, at least one temperature-resistant, coloring material or consists of one or more of such materials. The temperature-resistant material and thus the pigments are, for example, a ceramic having a color different from the blank and the workpiece. For example, the ceramic is white, colored or black and is preferably present in the form of particles. A plurality of partial regions of the identification can be present which have different colors in order to ensure an increased contrast within the identification. Unlike a phosphor, the ceramic is not designed for wavelength conversion of radiation. The ceramic is, for example, a ceramic based on aluminum oxide or aluminum titanate, a silicate ceramic, a nitride ceramic or a kaolin.

According to at least one embodiment, the identification comprises, as pigments, one or more phosphors or consists of one or more phosphors. The at least one phosphor then leads to a difference in reflection between the identification and the blank and the workpiece. Phosphors can have in spectral subregions, in which the phosphor emits by means of photoluminescence, a reflectance of more than 100%. A degree of reflection exceeding 100% is thus caused by the secondary light generated by the phosphor. The phosphor can be present in addition to the ceramic.

Preferably, the phosphor or the phosphor mixture comprises at least one of the following phosphors or consists thereof: $Eu^{2+}$-doped nitrides such as $(Ca,Sr)AlSiN_3:Eu^{2+}$, $Sr(Ca,Sr)Si_2Al_2N_6:Eu^{2+}$, $(Sr,Ca)AlSiN_3*Si_2N_2O:Eu^{2+}$, $(Ca,Ba,Sr)_2Si_5N_8:Eu^{2+}$, $(Sr,Ca)[LiAi_3N_4]:Eu^{2+}$; garnets from the general system $(Gd,Lu,Tb,Y)_3(Al,Ga,D)_5(O,X)_{12}:RE$ where X=halide, N or divalent element, D=trivalent or tetravalent element and RE=rare earth metals, such as $Lu_3(Al_{1-x}Ga_x)_5O_{12}:Ce^{3+}$, $Y_3(Al_{1-x}Ga_x)_5O_{12}:Ce^{3+}$; $Eu^{2+}$-doped sulphides such as $(Ca,Sr,Ba)S:Eu^{2+}$; $Eu^{2+}$-doped SiONs such as $(Ba,Sr,Ca)Si_2O_2N_2:Eu^{2+}$; SiAlONs in particular from the system $Li_xM_yLn_zSi_{12-(m+n)}Al_{(m+n)}O_nN_{16-n}$; beta-SiAlONs in particular from the system $Si_{6-x}Al_zO_yN_{8-y}:RE_z$; nitrido-orthosilicates such as $AE_{2-x-a}RE_xEu_aSiO_{4-x}N_x$, $AE_{2-x-a}RE_xEu_aSi_{1-y}O_{4-x-2y}N_x$ with RE=rare earth metal and AE=alkaline earth metal; orthosilicates such as $(Ba,Sr,Ca,Mg)_2SiO_4:Eu^{2+}$; chlorosilicates such as $Ca_8Mg(SiO_4)_4Cl_2:Eu^{2+}$; chlorophosphates such as $(Sr,Ba,Ca,Mg)_{10}(PO_4)_6Cl_2:Eu^{2+}$; BAM phosphors from the BaO—MgO—$Al_2O_3$ system such as $BaMgAl_{10}O_{17}:Eu^{2+}$; halophosphates such as $M_5(PO_4)_3(Cl,F):(Eu^{2+},Sb^{3+},Mn^{2+})$; SCAP phosphors such as $(Sr,Ba,Ca)_5(PO_4)_3Cl:Eu^{2+}$. The phosphors specified in document EP 2 549 330 A1 can also be used as phosphors. With regard to the phosphors used, the disclosure content of this document is incorporated by reference.

The phosphor can be used for a shortening of the wavelength of an excitation radiation, also referred to as an up conversion, and can then convert, for example, infrared light into visible light. Alternatively, the phosphor can convert short-wave light into long-wave light. The phosphor is excited in the near ultraviolet, visible and/or near-infrared spectral range. The phosphor is preferably read out in the visible or near ultraviolet spectral range.

It is possible for the phosphor to be changed in particular by the temperatures during rolling and/or of the subsequent temperature treatment in its luminescence properties. In this way, quality control can also be achieved whether the temperature treatment and/or the rolling are carried out with correct process parameters.

According to at least one embodiment, in step B) the identification is applied directly to the blank. The identification or a raw material for the identification is applied, for example, by means of analog printing such as screen printing or by digital printing such as inkjet. The identification or a raw material for the identification can also be sprayed on or applied by means of a voltage-driven method such as electrophoresis or electroplating. For example, the identification or the raw material is applied as a paste or as a liquid having ink properties. The identification can likewise be applied by means of laser writing, for example, with dye powders, as specified in document WO 2010/057470 A2. The disclosure content of this document is incorporated by reference.

According to at least one embodiment, the identification comprises an organic matrix material, for example, on an acrylate basis. By means of said organic matrix material, the identification, in particular the color-imparting component of the identification, such as the phosphor, is fastened to the blank at least in step B). The matrix material acts as a type of adhesive for the chromophoric component. The organic matrix material comprises, for example, a binder, an organic solvent, a dispersant and/or a plasticizer. In particular, a phosphor composition is used as described in document DE 602 18 966 T2. The disclosure content of this document is incorporated by reference.

If the identification contains an inorganic adhesion promoter for the adhesion between the pigments and the blank, which can be equivalent to an inorganic matrix material, the adhesion promoter softens preferably during rolling and/or during the temperature treatment. The pigments preferably do not soften or only barely soften during the process and an adhesion between the pigments and the metal body is achieved by the adhesion promoter and/or by sinking or pressing the adhesion promoter and the pigments bound thereto. Alternatively, the pigments adhere to the metal body solely by pressing into the blank during rolling.

According to at least one embodiment, the finished identification consists of the particles of the pigments and of the matrix material. In this case, the matrix material is preferably an inorganic material, for instance a glass based on silicon dioxide.

If the identification does not contain an inorganic adhesive agent, but only the pigments as an inorganic and solid component, the pigments preferably do not soften or only superficially soften during the process and an adhesion between the pigments and the metal body is obtained by bonding the pigments directly to a material of the metal body.

According to at least one embodiment, in a step E) after step C) the identification is removed from the finally shaped workpiece, for example, by cutting or punching. For example, the identification is cut off so that the metal body can be shortened during step E).

According to at least one embodiment, the matrix material breaks partially during deformation. This means that the matrix material can be ground during rolling. In this case, the pigment particles are preferably retained without damage. In particular, the matrix material has a lower hardness than the pigment particles.

According to at least one embodiment, the matrix material crushed during rolling is subsequently melted. The renewed melting preferably forms an envelope around the pigment particles so that a sealing results which the pigment particles are protected during the subsequent temperature treatment, for example, against reactions with a gas from the surrounding atmosphere.

As an alternative to such a matrix material, it is possible for the pigment particles to have a core-shell structure. The core is preferably responsible for the contrast of the identification and the shell prevents, for example, a chemical destruction of the core.

According to at least one embodiment, the pigment particles have a greater hardness than the blank, the metal body and/or a rolling tool for the rolling. Preferably, a hardness of the pigment particles lies between a hardness of the blank and of the rolling tool.

According to at least one embodiment, during rolling the thickness of the blank changes by at least a factor of 1.25 or 1.5 or 2 or 3 towards the metal body. Alternatively or additionally, during rolling the width changes by at most a factor of 1.001 or 1.001 or 1.00001. In other words, the thickness and thus the length of the blank change significantly, while the width of the blank remains constant. During rolling, an anisotropic deformation of the blank thus takes place.

According to at least one embodiment, the blank has a length of at least 100 m or 250 m or 0.5 km after the rolling. Alternatively or additionally, this length is at most 30 km or 10 km or 5 km.

According to at least one embodiment, the identification is applied over the entire length of the blank and/or of the metal body. For example, an identification region is applied at periodic regular intervals. A distance between adjacent identification regions is, for example, at least 0.1 m or 0.5 m and/or at most 10 m or 2 M.

According to at least one embodiment, the identification, viewed in a plan view, comprises a plurality of punctiform, island-shaped partial regions. The partial regions are separated from one another and are not connected to one another by a material of the identification. An average diameter of the partial regions is, for example, at least 0.5 μm or 1 μm and/or at most 50 μm or 20 μm or 10 μm. In this case, when seen in a plan view, the identification is preferably composed of the individual subregions which can be present in a density modulation. An average extent of the identification as a whole is preferably at least 20 times or 50 times the average diameter of the partial regions.

For example, the pigments are present in a homogeneous, densely packed or approximately densely packed, in particular single-layer distribution on the surface of the metal body. If island formation is to be provided, a uniform distribution of the islands over the identification region is preferably present, so that the islands appear to be contiguous with the naked eye or with a readout system.

According to at least one embodiment, the identification is formed by one or by a plurality of contiguous identification regions. The individual identification regions represent, for example, bars of a bar code, elements of a point code or matrix codes or digits, letters or symbols. Within the identification regions, the identification covers the workpiece completely, without gaps and in a continuous manner. A mean extension of the at least one identification region is preferably at least 20 times or 50 times a mean diameter of color pigments of the identification. The color pigments are, for example, ceramic, colored particles or phosphor particles.

Further, a workpiece is provided. The workpiece is produced using a method as indicated in connection with one or more of the above-mentioned embodiments. Features of the method are therefore also disclosed for the workpiece and vice versa.

In at least one embodiment, the workpiece comprises a rolled metal body having a length of at least 250 m and an identification with one or more different pigments, especially in particle form. The pigment is formed by at least one phosphor and/or by at least one ceramic. The metal body was treated by means of tempering and/or annealing. The identification is completely pressed into the metal body. The identification is located at least at both ends of the metal body on two opposite sides of the metal body. The identification, both to the blank as well as to the metal body, has a difference in reflection and/or a difference in remission and/or an albedo difference of at least 15 percentage points in at least part of the near ultraviolet, visible and/or near-infrared spectral region.

That the metal body is rolled and has been tempered or annealed, can be detected, for example, on the basis of the microstructure, a surface structure and/or a crystal grain size distribution.

BRIEF DESCRIPTION OF THE DRAWINGS

A method described here and a workpiece described here are explained in more detail below with reference to the drawing on the basis of exemplary embodiments. Identical reference signs indicate the same elements in the individual figures. However, no relationships to scale are shown; rather, individual elements can be represented with an exaggerated size in order to afford a better understanding.

In the figures.

DETAILED DESCRIPTION OF ILLUSTRATIVE EMBODIMENTS

FIG. 1 illustrates an exemplary embodiment of a method described herein. According to FIG. 1A, a slab is provided as a blank 2. The slab has, for example, approximate dimensions of 1 m×5 m×0.2 m. The slab is made of an iron alloy, for example.

Figure 1A:
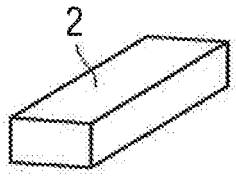
FIGS. 1A to 1H and FIGS. 3A to 3D show exemplary embodiments of method steps of methods for producing workpieces in schematic sectional illustrations and perspective representations.
Figure 1B:
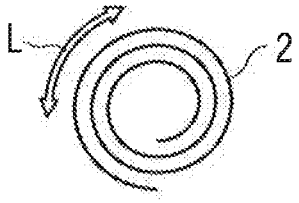

As an alternative to this, according to FIG. 1B a roll is provided as a blank 2. This roll is produced, for example, by hot rolling from a slab, for example, according to FIG. 1A. Measurements of the rolled-up blank 2 lie, for example, in the order of magnitude of 1 m×3 mm×5 km.

Figure 1C:
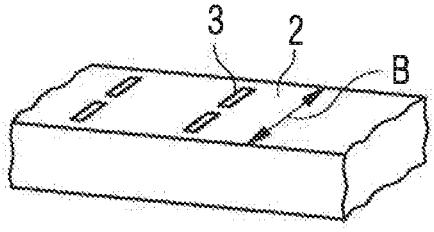

According to FIG. 1C, an identification 3 is applied to the blank 2 in places. The identification 3 is printed or sprayed on, for example, as a paste/ink. The paste/ink contains pigment particles and optionally a solvent and/or a binder. The solvent is configured to evaporate without residue in subsequent method steps. The optional binder is preferably designed to fasten the pigment particles to one another or to the blank 2. The pigment particles are, for example, ceramic particles or phosphor particles, wherein different types of pigment particles can be applied as a mixture.

Furthermore, FIG. 1C illustrates that the identification 3 is applied in a distorted manner, so that the individual regions of the identification 3 have a significantly smaller extent along a length L of the blank 2 than along a width B. The blank 2 of FIG. 1C is in particular the slab of FIG. 1A or the roll of FIG. 1B.

Figure 1D:
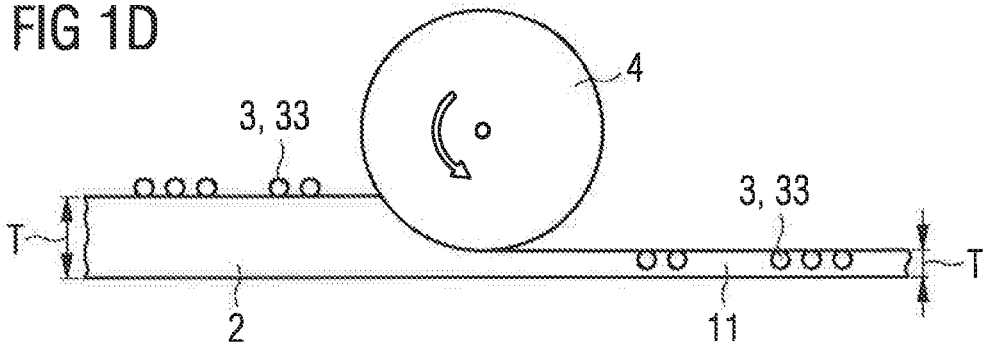

In the method step of FIG. 1D, the blank 2 is rolled to form a metal body 11. This is carried out with the aid of at least one rolling tool 4, schematically shown as only one single roll. A thickness T of the blank 2 towards the metal body 11 is significantly reduced by the rolling, the width B remains unchanged or virtually unchanged. Furthermore, a significant change in the length L takes place by the rolling. The length L of the finished rolled metal body 11 is preferably several 100 m.

Furthermore, the pigment particles, in particular a phosphor 33, are completely pressed into the metal body 11 by the rolling. The pigment particles have a greater hardness than the blank 2 and the metal body 11. The step of FIG. 1D is a hot rolling or a cold rolling.

Figure 1E:
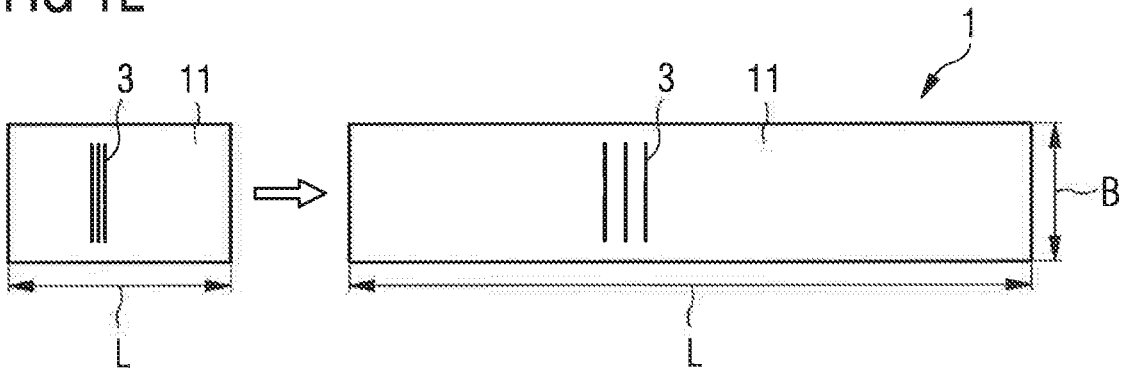

The change in the metal body 11 is illustrated in plan view in FIG. 1E. The rolling, symbolized by an arrow, changes the length L and thus also a distance between individual regions of the identification 3 along the length L. In the direction parallel to the width B, on the other hand, there is no or no significant change in the workpiece 11 and the identification 3. The thickness change cannot be seen from FIG. 1E.

Figure 1F:
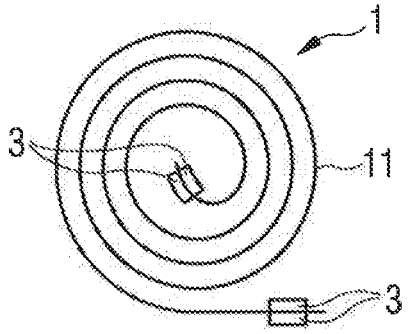

FIG. 1F shows the finished workpiece 1 with the metal body 11 and the identification 3. In this case, the workpiece 1 is rolled up in the form of a roll. One of the identifications 3 is located at both ends of the metal body 11 and on both main sides of the metal body 11. This allows the role to be identified in a simple manner.

Furthermore, a temperature treatment, in particular a recrystallization annealing, takes place in the step of FIG. 1F. The temperature treatment is carried out, for example, at a temperature of approximately 710° C. and over a duration of one to two weeks. The identification is not destroyed by the temperature treatment.

The temperature treatment, in particular the annealing, of whatever kind, can be carried out in a process gas such as, for example, in air, in an $N_2$ atmosphere or an $H_2$ atmosphere. In this case, it is advantageous if the identification contains pigments which do not react with the process gas, in particular do not oxidize or reduce, and thus a change in contrast occurs. In this way, alloy formations are also excluded. For example, $TiO_2$ as common pigment would be reduced a to Ti in an $H_2$ atmosphere; thus, the $TiO_2$ would become grey, and an intermetallic phase would optionally be formed with the metal body. Such a reaction should be avoided by the selection of the pigments and of the process gas.

Figure 1G:
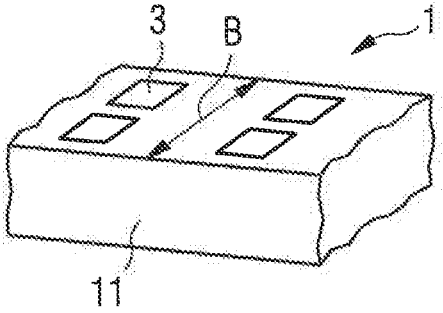

In the representation of FIG. 1G, it can be seen that the identification 3 itself has also been stretched by the rolling in FIG. 1D, and not only the workpiece 11, see FIG. 1C. The identification can thus be easily read after the rolling.

In particular in the case of temperature treatment after rolling, many different rolls are stored in a furnace over a comparatively long time. The identification of the roles is also possible after the temperature treatment by means of the identification 3, in contrast to this in the case of applied signs, which are destroyed by the rolling, or by means of inks on an organic basis, which are destroyed by the high temperatures.

Figure 1H:
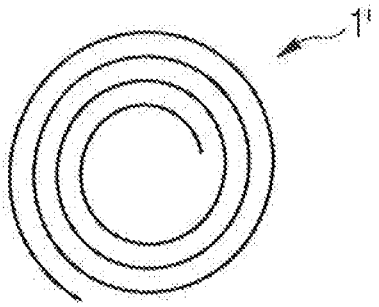

Optionally, see FIG. 1H, the identification can be removed before being delivered, so that a workpiece 1' without identification results. The identification is removed without traces and without residue, for example, by punching, wherein the section of the workpiece bearing the identification is separated.

Thus, in particular for the purpose of traceability using the method described herein, a unique identification of raw materials, semi-finished products and products is possible even across temperature treatments. For some objects, this marking is otherwise difficult, since extreme process conditions are run through which lead to failure of other marking methods. Without such an identification, confusion or the loss of marking, for example, in steel works and in rolling mills, occur quite often. The method of marking described here allows the identification 3 to be permanently attached to the workpiece 1. Confusion or loss of the identification 3 does therefore no longer occur.

A main idea of the method described here is thus to apply an identification 3 which is in the form of an ink, paste or the like and which is applied directly to the material surface, in particular by printing on a code. The paste or the ink preferably contains hard, exclusively inorganic pigments, particularly preferably ceramic pigments and inorganic coloring substances and luminescent substances, which are permanently pressed on and/or into a metal surface by the rolling process. Adhesion of the pigments to or in the material surface is better than that to the rolling die.

The coding by the identification 3 takes place, for example, in 1D form of a barcode, so that a stretching of the coding in the rolling direction does not impair the readability. The coding is preferably selected to be in 2D form, in such a way that a stretching of the coding in the rolling direction leads to a coding in the correct aspect ratio, since the identification 3 is initially applied to the unrolled blank 2 in a compressed form. The contrast between the workpiece surface and the pigments is high, even at low pigment concentration, relative to an area proportion, especially as a result of that the pigments can be a ceramic phosphor, so that stretching of the workpiece and the associated reduction of the pigment surface concentration during rolling do not lead to an unreadability of the coding. Thus, right from the start, a low concentration of the pigments can be applied and printed, which is preferably not visible to the naked eye. Due to the low concentration of the pigments on the surface, other functional-relevant properties of the workpiece are not changed or only insignificantly changed and follow-up processes, such as, in particular, painting, and the planned component use are not disturbed. Since such ceramic pigments are temperature-stable, long temperature treatments are also possible.

According to FIG. 2, marking is carried out continuously by the identification 3 on the metal body 11, preferably as a recurring pattern, for example, in the form of a barcode or simply only in the form of points at a defined distance of, for example, 1 m. As a result, a proof of authenticity is possible over the entire roll, in particular during the rolling of the metal body 11 from the roll, for example, in that the pigments are a customer-specific mixture of phosphor pigments.

Figure 2A:
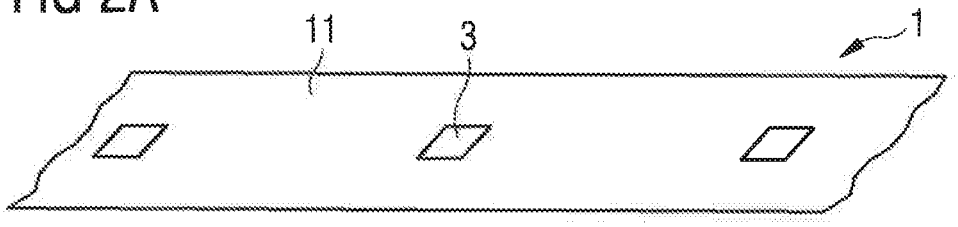
FIGS. 2A to 2B show schematic perspective representations of exemplary embodiments of workpieces.
Figure 2B:
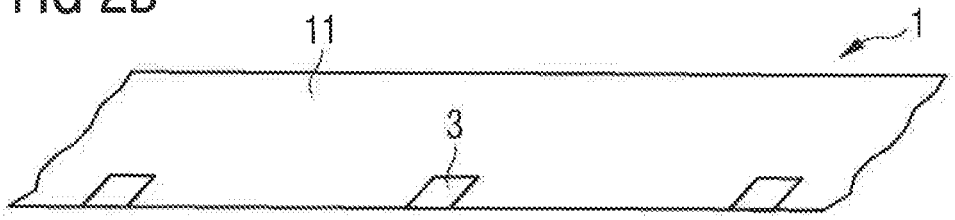

In this case, see FIG. 2A, the individual regions for the identification 3 can be applied centrally along a longitudinal axis to a main side of the metal body ii. Likewise, see FIG. 2B, the individual regions of the identification 3 can be located on an edge of the metal body 11 so that the metal body 11 can also be identified in the rolled-up state.

Figure 3A:
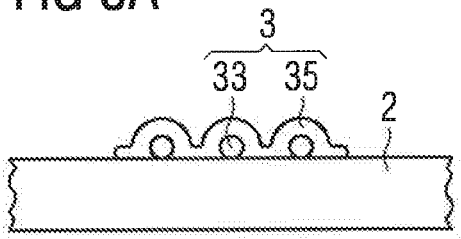

In the method of FIG. 3A, the pigment particles, in particular the phosphor 33, are applied to the blank 2. Subsequently, a matrix material 35, for example, a low-melting glass, is applied and optionally melted. As a result, the pigment particles 33 can be embedded in the matrix material 35.

Figure 3B:
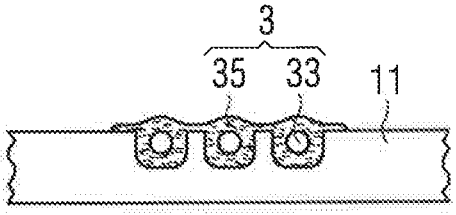

Prior to the representation in FIG. 3B, the rolling is carried out. As a result, the particles 33 are pressed into the metal body 11. In this case, the matrix material 35 was partially destroyed and broken during rolling. However, the matrix material 35 still surrounds the particles 33.

Figure 3C:
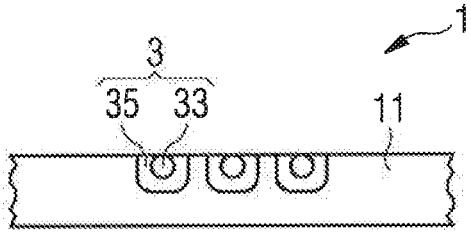

In a subsequent step, see FIG. 3C, the matrix material 35 is melted again, resulting in a tight sealing of the particles 33. Optionally, the remaining regions of the surface of the metal body 11, on which no particles 33 are located, can be freed from the matrix material 35.

Figure 3D:
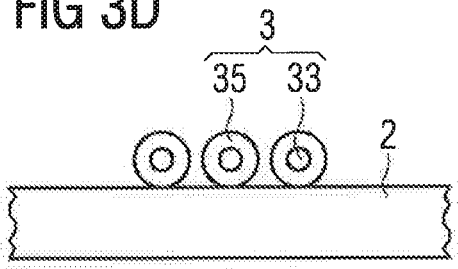

Alternatively, see FIG. 3D, it is possible for core-shell particles to be used, which already have a seal 35 around the ceramic core or around the phosphor core 33 in the step of applying them. This core-shell structure is preferably not destroyed during rolling.

Furthermore, it is possible for the pigment particles themselves to be thermally stable so that a matrix material or a seal can be omitted.

Figure 4A:
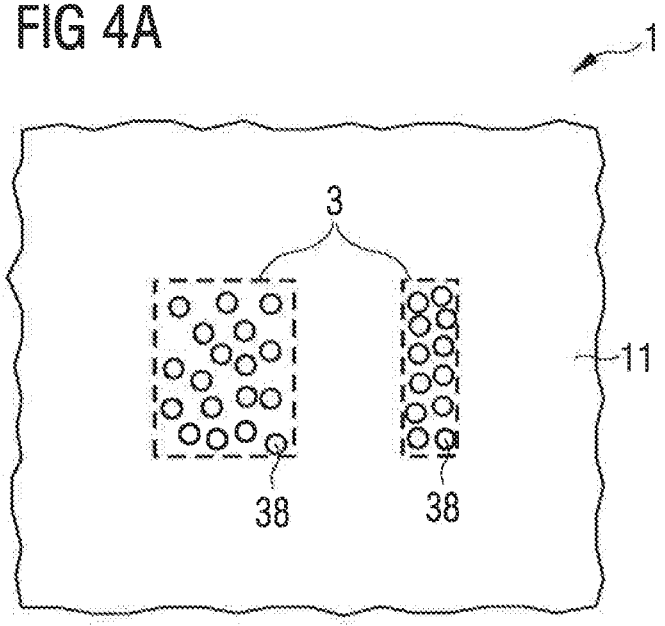
FIGS. 4A to 4B show schematic plan views of exemplary embodiments of workpieces.

The individual pigment particles of the identification 3 form island-shaped subregions 38 which are grouped, see FIG. 4A. The grouped subregions 38 combine the identification 3, for example, to form a bar code or to form a written text. The individual pigment particles in the partial regions are not interconnected by a material of the identification 3.

Figure 4B:
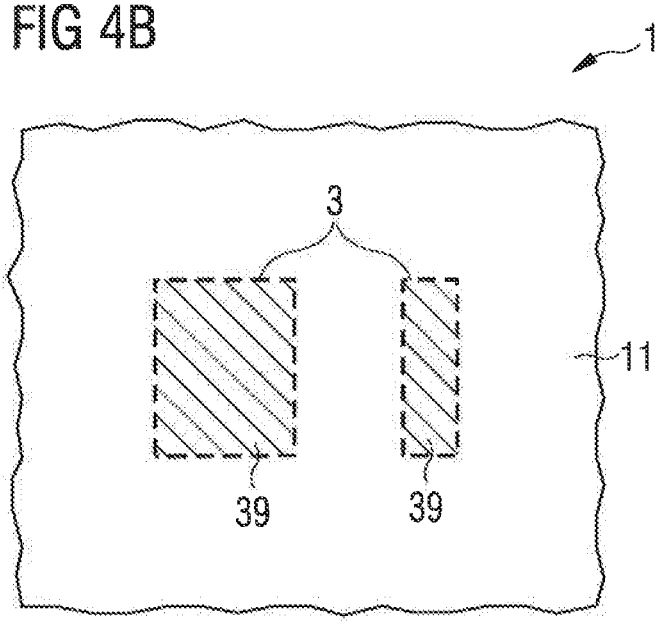

FIG. 4B shows that the identification 3 is formed by a plurality of contiguous identification regions 39. A thickness of the identification regions is, for example, at least 0.5 μm or 2 μm and/or at most 10 μm or 25 μm; a degree of coverage of the metal body 11 with the pigment particles in the region of the identification is alternatively or additionally at least 5% or 10% and/or at most 50% or 30%, as can also be the case in all other exemplary embodiments.

In the identification regions 39 of FIG. 4B, the pigment particles 33 can be densely or approximately densely packed next to one another, wherein the matrix material 35 can form a continuous layer.

The invention described herein is not restricted by the description on the basis of the exemplary embodiments. Rather, the invention encompasses any new feature and also any combination of features, which includes in particular any combination of features in the patent claims, even if this feature or this combination itself is not explicitly specified in the patent claims or exemplary embodiments.

The invention claimed is:

1. A method for marking workpieces, the method comprising:

providing a blank;

applying an identification comprising a phosphor to the blank in places; and after applying the identification to the blank, deforming the blank to form a metal body, wherein deforming the blank comprises rolling so that a relative change in thickness of the blank is larger than a relative change in width of the blank when the metal body is formed, wherein the identification remains on the metal body at least until after deforming the blank and is not destroyed by deforming the blank, and wherein the identification, both to the blank and to the metal body, has at least one of a difference in reflection, a difference in remission or an albedo difference of at least 15 percentage points in at least part of at least one of a near ultraviolet spectral region, a visible spectral region or a near-infrared spectral region.

2. The method according to claim 1, further comprising, after deforming the blank, tempering or annealing the metal body so that the metal body comprising the identification is heated to a temperature of at least 350° C. for a time period of at least one hour, wherein, while deforming the blank, the identification is completely pressed into the blank, and wherein the identification differs both from the blank and from the metal body before deforming the blank and after tempering or annealing in a machine-readable manner at least in the near ultraviolet spectral region, the visible spectral region or the near-infrared spectral region.

3. The method according to claim 1, wherein applying the identification comprises applying the identification at least at both ends of the blank and on two opposite sides of the blank, and wherein the identification differs both from the blank and from the metal body, before deforming the blank and after tempering or annealing, in a machine-readable manner in the visible spectral region.

4. The method according to claim 1, wherein the thickness is changed by at least a factor of 1.5 and the width is changed by at most a factor of 1.001 while deforming the blank, and wherein, after deforming the blank, the metal body has a length of at least 250 m.

5. The method according to claim 1, wherein applying the identification comprises applying the identification periodically over an entire length of the blank.

6. The method according to claim 1, wherein the identification is formed by at least one contiguous identification region, and wherein the at least one identification region has an average extent of at least 20 times a mean diameter of pigments of the identification.

7. A method for marking workpieces, the method comprising:

providing a blank;

applying an identification to the blank in places; and after applying the identification to the blank, deforming the blank to form a metal body, wherein deforming the blank comprises rolling so that a relative change in thickness of the blank is larger than a relative change in width of the blank when the metal body is formed, wherein the identification remains on the metal body at least until after deforming the blank and is not destroyed by deforming the blank, wherein the identification, both to the blank and to the metal body, has at least one of a difference in reflection, a difference in remission or an albedo difference of at least 15 percentage points in at least part of at least one of a near ultraviolet spectral region, a visible spectral region or a near-infrared spectral region, wherein the identification comprises at least one phosphor causing the difference in reflection, the difference in remission or the albedo difference, wherein the identification comprises a light-permeable, inorganic matrix material which seals the phosphor at least after deforming the blank, and wherein the identification is fastened to the blank and to the metal body by the matrix material.

8. The method according to claim 7, wherein, while deforming the blank, the identification is completely pressed into the blank.

9. The method according to claim 7, further comprising, after deforming the blank, tempering or annealing the metal body so that the metal body comprising the identification is heated to a temperature of at least 350° C. for a time period of at least one hour.

10. The method according to claim 7, wherein applying the identification comprises applying the identification at least at both ends of the blank and on two opposite sides of the blank, and wherein the identification differs both from the blank and from the metal body, before deforming the blank and after tempering or annealing, in a machine-readable manner in the visible spectral region.

11. The method according to claim 7, wherein the thickness is changed by at least a factor of 1.5 and the width is changed by at most a factor of 1.001 while deforming the blank, and wherein, after deforming the blank, the metal body has a length of at least 250 m.

12. The method according to claim 7, wherein applying the identification comprises applying the identification periodically over an entire length of the blank.

13. A method for marking workpieces, the method comprising:

providing a blank;

applying an identification to the blank in places; and after applying the identification to the blank, deforming the blank to form a metal body, wherein deforming the blank comprises rolling so that a relative change in thickness of the blank is larger than a relative change in width of the blank when the metal body is formed, wherein the identification remains on the metal body at least until after deforming the blank and is not destroyed by deforming the blank, wherein the identification, both to the blank and to the metal body, has at least one of a difference in reflection, a difference in remission or an albedo difference of at least 15 percentage points in at least part of at least one of a near ultraviolet spectral region, a visible spectral region or a near-infrared spectral region, wherein the identification, viewed in plan view, is formed by a plurality of punctiform, island-shaped subregions having an average diameter of at most 50 μm, wherein the identification, seen in plan view and all subregions taken together, has a mean extension of at least 20 times the average diameter, and wherein a mean roughness of a surface of the workpiece at the identification deviates from a mean roughness of remaining regions of the surface of the workpiece by at most a factor of 2.

14. The method according to claim 13, wherein the identification comprises at least one phosphor causing at least one of the difference in reflection, the difference in remission or the albedo difference, wherein the identification comprises a light-permeable, inorganic matrix material which seals the phosphor at least after deforming the blank, and wherein the identification is fastened to the blank and to the metal body by the matrix material.

15. The method according to claim 14, wherein the matrix material partially breaks while deforming the blank and is subsequently melted again in order to seal the phosphor, and wherein the phosphor has a greater hardness than the blank, the metal body and a rolling tool.

16. The method according to claim 13, wherein, while deforming the blank, the identification is completely pressed into the blank.

17. The method according to claim 13, further comprising, after deforming the blank, tempering or annealing the metal body so that the metal body comprising the identification is heated to a temperature of at least 350° C. for a time period of at least one hour.

18. The method according to claim 13, wherein applying the identification comprises applying the identification at least at both ends of the blank and on two opposite sides of the blank, and wherein the identification differs both from the blank and from the metal body, before deforming the blank and after tempering or annealing in a machine-readable manner in the visible spectral region.

19. The method according to claim 13, wherein the thickness is changed by at least a factor of 1.5 and the width is changed by at most a factor of 1.001 while deforming the blank, and wherein, after deforming the blank, the metal body has a length of at least 250 m.

* * * * *